US010047639B2

(12) United States Patent
Sato et al.

(10) Patent No.: US 10,047,639 B2
(45) Date of Patent: Aug. 14, 2018

(54) CAMSHAFT AND MANUFACTURING METHOD THEREFOR

(71) Applicant: HONDA MOTOR CO., LTD., Tokyo (JP)

(72) Inventors: Fumio Sato, Tochigi-ken (JP); Hiroshi Takeda, Tochigi-ken (JP); Takuro Yoshimura, Tochigi-ken (JP); Yuta Daimon, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/458,455

(22) Filed: Mar. 14, 2017

(65) Prior Publication Data

US 2017/0268385 A1 Sep. 21, 2017

(30) Foreign Application Priority Data

Mar. 18, 2016 (JP) ..... 2016-054613

(51) Int. Cl.
*F01L 1/04* (2006.01)
*F01L 1/047* (2006.01)

(52) U.S. Cl.
CPC ..... *F01L 1/047* (2013.01); *F01L 1/042* (2013.01); *F01L 2001/0471* (2013.01)

(58) Field of Classification Search
CPC .... F01L 1/047; F01L 1/042; F01L 2001/0471
USPC ..... 123/90.16, 90.44, 90.6
See application file for complete search history.

(56) References Cited

U.S. PATENT DOCUMENTS 7,513,232 B2 * 4/2009 Schneider ..... F01L 1/34 123/90.17
2012/0160055 A1 6/2012 Tateno
2012/0160197 A1 6/2012 Matsunaga et al.

FOREIGN PATENT DOCUMENTS

WO 2011/089809 7/2011
WO 2012/090300 7/2012

* cited by examiner

*Primary Examiner* — Ching Chang
(74) *Attorney, Agent, or Firm* — Rankin, Hill & Clark LLP

(57) ABSTRACT

A camshaft is equipped with an inner shaft which is arranged rotatably inside a cylindrical outer shaft. Further, in the inner shaft, a plurality of pin holes extend along diametrical directions thereof, and are disposed at intervals along the axial direction of the inner shaft. The directions in which adjacent pin holes extend are arranged at angles obtained by dividing 360 degrees by the number of cylinders. The inner shaft and the inner cams are fixed in a state in which large diameter portions of pins, each of which is provided with a small diameter portion and a large diameter portion, are press-fitted through insertion holes of the inner cams and notches of the outer shaft, and are press-fitted into the pin holes.

7 Claims, 5 Drawing Sheets

CAMSHAFT AND MANUFACTURING METHOD THEREFOR

CROSS-REFERENCE TO RELATED APPLICATION

This application is based upon and claims the benefit of priority from Japanese Patent Application No. 2016-054613 filed on Mar. 18, 2016, the contents of which are incorporated herein by reference.

BACKGROUND OF THE INVENTION

Field of the Invention

The present invention relates to a camshaft as well as a manufacturing method therefor, in which the relative positioning between outer cams and inner cams can be varied in order to arbitrarily control the opening angles and opening times of engine valves.

Description of the Related Art

As a camshaft for opening and closing engine valves provided in cylinders of an internal combustion engine, there are known, for example, as proposed in International Publication Nos. WO 2011/089809 and WO 2012/090300, devices by which the relative positioning between outer cams and inner cams are made variable in order to arbitrarily control the opening angles of the engine valves.

More specifically, a camshaft is equipped with a cylindrical outer shaft on which outer cams are provided on the outer circumference thereof, and an inner shaft, which is arranged rotatably in the interior of the outer shaft. Notches having shapes along the circumferential direction thereof are formed on the outer shaft, whereas, through the notches, inner cams are fixed to the inner shaft from the outer side. Therefore, when the inner shaft is rotated relatively with respect to the outer shaft, the inner cams rotate in following relation with the inner shaft (in so-called co-rotation therewith), and slide in the circumferential direction along the outer circumferential surface of the outer shaft. Consequently, the relative positioning between the outer cams and the inner cams can be made variable.

With the camshaft, fixing of the inner cams with respect to the inner shaft is carried out using pins. More specifically, pin holes are provided in the inner shaft that extend along diametrical directions thereof, and insertion holes are formed in the inner cams. In addition, the inner cams are fixed with respect to the inner shaft by press-fitting the pins, from a diametrical direction of the inner cams, into the pin holes through the insertion holes and the notches.

At this time, there is a concern that if the inner shaft were to become bent inside the outer shaft due to frictional resistance upon press-fitting the pins into the pin holes, the outer circumferential surface of the inner shaft would become fixed in a state of being pressed into contact with the inner circumferential surface of the outer shaft. In such a case, frictional resistance is generated mutually between the outer shaft and the inner shaft accompanying relative rotation between the outer shaft and the inner shaft. For this reason, there is a concern that rotation of the respective members would be hindered, the accuracy in adjusting the relative positions of the outer cams and the inner cams would be decreased, and the contact surfaces of the outer cams and the inner cams may become worn, whereby the durability of the camshaft is deteriorated.

Thus, with the camshaft disclosed in International Publication No. WO 2011/089809, the inner diameters of the pin holes are made greater than the diameters of the pins, and frictional resistance that occurs when the pins are inserted into the pin holes is decreased. In this case, both end portions in the axial direction of the pins that penetrate through the pin holes are caulked, and large diameter portions (stopper portions) are formed thereon, whereby the pins are fixed with respect to the pin holes.

Further, with the camshaft disclosed in International Publication No. WO 2012/090300, in order to prevent fixing thereof in a state in which the outer circumferential surface of the inner shaft is pressed into contact with the inner circumferential surface of the outer shaft, after the pins have been press-fitted into the pin holes, the pins are moved in directions opposite to the directions in which the pins were press-fitted. More specifically, pins are used which are composed of a small-diameter portion and a large-diameter portion, and a rod-shaped pushback tool is used together therewith. The small diameter portions of the pins have diameters of a size adapted to be press-fitted into the pin holes, whereas the large diameter portions have larger diameters than the inside diameters of the pin holes. Further, a stepped portion is formed mutually between the small diameter portion and the large diameter portion.

More specifically, initially, the small diameter portion of the pin is press-fitted from one end side of a pin hole that penetrates through the inner shaft, and the stepped portion is brought temporarily into abutment against the outer circumferential surface of the inner shaft. Next, the pushback tool is inserted from through holes that are formed in the inner cam and the outer shaft, so as to face the other end side of the pin hole, whereupon an end surface of the small diameter portion is pressed thereby. In accordance therewith, together with moving the pin in a direction opposite to the direction in which it was inserted, the relative positioning of the inner shaft with respect to the outer shaft is adjusted, and a clearance is formed mutually between the inner shaft and the outer shaft.

SUMMARY OF THE INVENTION

However, according to the configuration of International Publication No. WO 2011/089809, when the pins are inserted through the pin holes, if the respective axial centers thereof do not coincide highly accurately, ultimately, since frictional resistance occurs mutually therebetween, bending of the inner shaft cannot easily be suppressed. Further, since a caulking process or the like is required to fix the pins in the pin holes, there is a concern regarding the complexity of the manufacturing process for the camshaft, and manufacturing efficiency is lowered.

Further, according to the configuration of International Publication No. WO 2012/090300, after bending or flexure thereof has occurred, the inner shaft is again displaced in a direction opposite to the direction of flexure, and the occurrence of flexure itself cannot be suppressed. Consequently, after having press-fitted the pins into the pin holes, a step is necessary to further move the pins in a direction opposite to the direction in which they were press-fitted, and in this case as well, there is a concern regarding the complexity of the manufacturing process for the camshaft, and manufacturing efficiency is lowered.

A principal object of the present invention is to provide a camshaft which can easily and efficiently prevent bending of an inner shaft when inner cams are fixed to the camshaft.

Another object of the present invention is to provide a method of manufacturing such a camshaft.

According to an embodiment of the present invention, a camshaft is provided for opening and closing engine valves provided respectively in a plurality of cylinders of an internal combustion engine, comprising a cylindrical outer shaft on which outer cams are provided on an outer circumference thereof, an inner shaft disposed rotatably in the interior of the outer shaft, and inner cams, which are fixed to the inner shaft by pins through notches of the outer shaft, whereby the inner cams are rotated together with the inner shaft, and slide along a circumferential direction on an outer circumferential surface of the outer shaft. The pins each comprise a small diameter portion, and a large diameter portion which is larger in diameter than the small diameter portion. The inner shaft is provided with a plurality of pin holes therein which extend along diametrical directions of the inner shaft, the pin holes are disposed at intervals along an axial direction of the inner shaft, and the directions in which adjacent pin holes extend are arranged at an angle obtained by dividing 360 degrees by the number of cylinders. Each of the pin holes has an inner diameter so that the small diameter portion is loosely fitted, and the large diameter portion is press-fitted therein, the inner cams are formed with insertion holes having an inner diameter into which the large diameter portion is loosely fitted, and the inner shaft and the inner cams are fixed in a state in which the large diameter portions are press-fitted into the pin holes through the insertion holes and the notches.

With the camshaft according to the present invention, since the pin holes are arranged in the manner described above, the directions of insertion of the pins to the pin holes also differ between the adjacent pins by the angles (hereinafter also referred to as predetermined angles), which are obtained by dividing 360 degrees by the number of cylinders. Further, the pins are provided with the large diameter portion and the small diameter portion, the respective sizes of which differ from each other in the manner described above.

Therefore, by loosely fitting the small diameter portions with respect to all of the pin holes through the insertion holes and the notches, the inner shaft can be supported in a balanced manner from different directions, respectively, in the circumferential direction of the inner shaft. Owing to this feature, since the large diameter portions can be press-fitted into the pin holes in a state in which displacement of the inner shaft is suppressed, the inner cams can be fixed to the inner shaft while suppressing the occurrence of bending or flexure of the inner shaft.

Press-fitting of the large diameter portions preferably is performed simultaneously with respect to all of the pin holes, however, press-fitting thereof may also be performed sequentially. Since the relative positioning of the inner shaft with respect to the outer shaft is temporarily fixed by loose fitting of the small diameter portions, in this case as well, bending or flexure can be suppressed regardless of the timing at which the large diameter portions are press-fitted into the pin holes.

More specifically, with the camshaft, any concerns over the outer circumferential surface of the inner shaft becoming fixed in a state of being pressed in contact with the inner surface of the outer shaft can be dispensed with. Therefore, it is possible to suppress generation of frictional resistance mutually between the outer shaft and the inner shaft accompanying relative rotation of the outer shaft and the inner shaft. In accordance therewith, it is possible to prevent relative rotation between the outer shaft and the inner shaft from being obstructed, and the accuracy in adjusting the relative positioning of the outer cams and the inner cams can be improved. Further, since frictional wear due to contact between the outer shaft and the inner shaft can be suppressed, the durability of the camshaft can be enhanced.

Even if the occurrence of flexure in the inner shaft is suppressed in the foregoing manner, there is no need for additional processing steps, such as caulking for fixing the pins in the pin holes, or a step, after the pins have been press-fitted into the pin holes, of moving the pins in directions opposite to the direction in which they were press-fitted. Therefore, the camshaft can be obtained easily and efficiently.

Furthermore, in the foregoing manner, the pin holes are arranged at positions having predetermined angles that differ with respect to the circumferential direction of the inner shaft, and therefore, the notches, which are formed in facing relation to the pin holes, also are formed at positions having predetermined angles that differ with respect to the circumferential direction of the outer shaft. With such an inner shaft and an outer shaft, since the plural pin holes or the notches are arranged evenly along the circumferential direction, it is possible to suppress the occurrence of anisotropy in the rigidity thereof.

As described above, in such a camshaft, the outer cams and the inner cams can be relatively displaced with high accuracy, and the camshaft is superior in terms of durability and manufacturing efficiency.

In the above-described camshaft, the inner cams preferably are C-shaped in cross section, in which an opening is provided between both ends in the circumferential direction thereof that enables the outer shaft to be passed therethrough along a diametrical direction, and are mounted to locations adjacent to the outer cams of the outer shaft slidably along a circumferential direction thereof, and further, a distance between both end portions that form the opening of the inner cams preferably is less than an outer diameter of locations of the outer shaft where the inner cams are mounted.

In this case, openings which enable the outer shaft to be passed therethrough in the diametrical direction are provided in the inner cams. Therefore, for example, unlike the case in which an annular inner cam is attached to the outer shaft, it is not necessary to insert the outer shaft inside a base circle of the inner cam from one end thereof in the axial direction, and to place the inner cam in a predetermined position while sliding the members mutually along the axial direction. More specifically, since the inner cams can be attached from the diametrical direction thereof with respect to the outer shaft after the outer cams have been provided thereon, the camshaft can be obtained more easily and with greater efficiency.

In the above-described camshaft, each of the inner cams preferably has defined as a boundary thereof a diametrical direction, which is perpendicular to a direction in which the outer shaft is passed through the opening, and when the circumferential direction is partitioned respectively into two half-circumferences on a side of the opening and on a side opposite to the opening, a single one of the insertion holes is formed on a cam surface of the half-circumference on the side opposite to the opening including the boundary, and the pins, which are inserted into the pin holes through the insertion holes and the notches, do not pass through the inner shaft.

In this case, the insertion holes are formed by avoiding both end sides of the inner cams near to the openings. Further, the pins that are inserted into the pin holes via the insertion holes do not penetrate or pass through the inner shaft. Therefore, when the insertion holes are formed in the inner cams, or when press-fitting the pins into the pin holes through the insertion holes, it is possible to avoid application of stresses, which may result in damage, with respect to locations on both sides of the openings of the inner cams. Therefore, without any reduction in yield, camshafts can be obtained more easily and with greater efficiency.

According to another embodiment of the present invention, a method for manufacturing a camshaft is provided, the camshaft serving to open and close engine valves provided respectively in a plurality of cylinders of an internal combustion engine, comprising a fixing step of fixing inner cams with respect to an inner shaft, which is disposed rotatably in interior of an outer shaft on which outer cams are provided on an outer circumference thereof, the inner cams being fixed by pins through notches that are formed in the outer shaft. In this method, the inner shaft is provided with a plurality of pin holes therein which extend along diametrical directions of the inner shaft, the pin holes are disposed at intervals along an axial direction of the inner shaft, and the directions in which adjacent pin holes extend are arranged at an angle obtained by dividing 360 degrees by the number of cylinders. Further, the inner cams are formed with insertion holes having an inner diameter into which the pins are loosely fitted, and in the fixing step, the inner cams are fixed to the inner shaft by press-fitting the pins respectively through the insertion holes and the notches simultaneously with respect to all of a plurality of the pin holes.

According to such a manufacturing method for a camshaft, by simultaneously press-fitting the pins into all of the pin holes, which are arranged as described above, frictional resistance that occurs due to press-fitting of the pins is generated uniformly from different directions in the circumferential direction of the inner shaft. Therefore, bending of the inner shaft by displacement of the inner shaft in one particular direction can be avoided. Further, for example, while confirming the relative positioning of the inner shaft with respect to the outer shaft, fine adjustments can be made to the respective speeds at which the plurality of pins are press-fitted, whereby it is possible to suppress displacement of the inner shaft with higher accuracy.

Further, with the manufacturing method, even if flexure of the inner shaft is suppressed in the foregoing manner, there is no need for additional processing steps, such as caulking for fixing the pins in the pin holes, or a step, after the pins have been press-fitted into the pin holes, of moving the pins in directions opposite to the direction in which they were press-fitted. Additionally, since the pins are press-fitted simultaneously into all of the pin holes in order to fix the inner cams to the inner shaft, the manufacturing efficiency of the camshaft can be improved effectively.

Furthermore, since the pin holes or the notches are formed at different positions at each of predetermined angles with respect to the circumferential direction of the inner shaft and the outer shaft, it is possible to suppress the occurrence of anisotropy in the rigidity of the inner shaft and the outer shaft.

As described above, it is possible for the outer cams and the inner cams to be relatively displaced with high accuracy, and camshafts which are superior in terms of durability can be obtained easily and efficiently.

According to another embodiment of the present invention, a method for manufacturing a camshaft is provided, the camshaft serving to open and close engine valves provided respectively in a plurality of cylinders of an internal combustion engine, comprising a fixing step of fixing inner cams with respect to an inner shaft, which is disposed rotatably in interior of an outer shaft on which outer cams are provided on an outer circumference thereof, the inner cams being fixed by pins through notches that are formed in the outer shaft. In this method, the pins each comprise a small diameter portion and a large diameter portion which is larger in diameter than the small diameter portion, and the inner shaft is provided with a plurality of pin holes therein which extend along diametrical directions of the inner shaft, the pin holes are disposed at intervals along an axial direction of the inner shaft, and the directions in which adjacent pin holes extend are arranged at an angle obtained by dividing 360 degrees by the number of cylinders. Further, each of the pin holes has an inner diameter so that the small diameter portion is loosely fitted, and the large diameter portion is press-fitted therein, the inner cams are formed with insertion holes having an inner diameter into which the large diameter portion is loosely fitted, the insertion holes being coaxial with the pin holes, and in the fixing step, the inner cams are fixed to the inner shaft, at first, by loosely fitting the small diameter portions respectively through the insertion holes and the notches simultaneously with respect to all of a plurality of the pin holes, and thereafter, by press-fitting the large diameter portions respectively into the pin holes.

According to such a manufacturing method for a camshaft, by loosely fitting the small diameter portions with respect to all of the pin holes, which are arranged as described above, the inner shaft can be supported uniformly from directions that differ respectively in the circumferential direction. Owing to this feature, when the large diameter portions are press-fitted into the pin holes, the occurrence of bending or flexure of the inner shaft can easily be suppressed.

Further, even if the occurrence of flexure in the inner shaft is suppressed in the foregoing manner, there is no need for additional processing steps, such as caulking for fixing the pins in the pin holes, or a step, after the pins have been press-fitted into the pin holes, of moving the pins in directions opposite to the direction in which they were press-fitted. Therefore, the camshaft can be obtained easily and efficiently.

Furthermore, since the pin holes or the notches are formed at different positions at each of predetermined angles with respect to the circumferential direction of the inner shaft and the outer shaft, it is possible to suppress the occurrence of anisotropy in the rigidity of the inner shaft and the outer shaft.

As described above, it is possible for the outer cams and the inner cams to be relatively displaced with high accuracy, and camshafts which are superior in terms of durability can be obtained easily and efficiently.

In the method for manufacturing the camshaft, as described above, in the fixing step, the large diameter portions preferably are press-fitted, respectively, simultaneously with respect to all of the plurality of pin holes. In this case, since it is possible for frictional resistance caused by press-fitting the pins to be generated evenly from respective different directions in the circumferential direction of the inner shaft, bending or flexure of the inner shaft can be avoided more effectively.

In the method for manufacturing the camshaft, as described above, in the fixing step, the large diameter portions may be press-fitted, at first, from pin holes disposed on respective sides nearer to both ends in the axial direction of the inner shaft than a pin hole disposed at a center side in the axial direction of the inner shaft. As described above, by loosely fitting the small diameter portions into the pin holes, the relative positioning of the inner shaft with respect to the outer shaft can be temporarily fixed. In accordance with this feature, although bending or flexure can be suppressed regardless of the timing at which the large diameter portions are press-fitted into the pin holes, by press-fitting the large diameter portions from the pin holes on both end sides first in the axial direction of the inner shaft, flexure of the inner shaft can be suppressed even more effectively.

More specifically, upon press-fitting the pins into the pin holes, although both ends of the inner shaft can be supported in a state of being positioned with respect to the outer shaft, it is difficult to support the central portion of the inner shaft, which is disposed in the interior of the outer shaft. Therefore, when the pins are press-fitted into the pin holes, the center side in the axial direction of the inner shaft is more likely to undergo flexure than both end sides thereof.

Thus, initially, the large diameter portions are press-fitted into the pin holes on both end sides of the inner shaft where it is relatively difficult for flexure to take place. Consequently, because both end sides of the inner shaft are positioned and fixed in a state in which flexure is suppressed, it can be made difficult for bending or flexure of the inner shaft to occur at a location thereof closer to the center side than the pin holes into which the pins have been press-fitted. In this manner, by press-fitting the pins sequentially into the pin holes, it is possible to more effectively suppress bending or flexure from occurring over the entire axial direction of the inner shaft.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Figure 1:
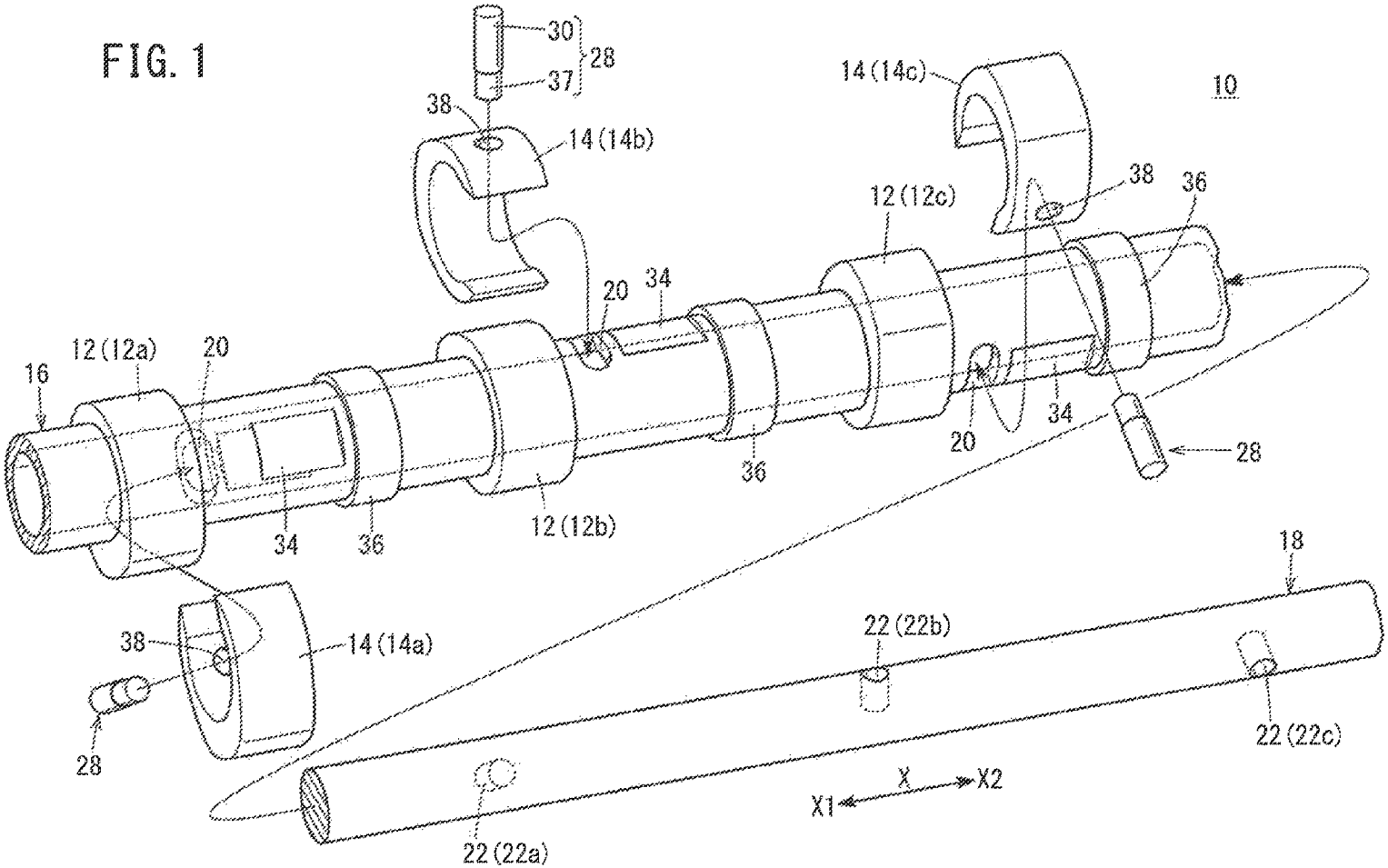
FIG. 1 is an outline exploded perspective view of a camshaft according to an embodiment of the present invention.

Preferred embodiments of a method for manufacturing a camshaft according to the present invention will be described in detail below with reference to the accompanying drawings.

As shown in FIG. 1 and FIGS. 2A through 2C, a camshaft 10 according to the present embodiment is used in an internal combustion engine (not shown) having three cylinders, and intake valves or exhaust valves (hereinafter referred to as engine valves, none of which are shown) provided in the respective cylinders are each opened and closed through one pair of an outer cam 12 and an inner cam 14. Therefore, a total of three pairs of outer cams 12 and inner cams 14 are provided.

One pair of the outer cam 12 and the inner cam 14 are arranged adjacent to each other along the axial direction of the camshaft 10, which are driven by the same rocker arm (not shown). Stated otherwise, by using a composite profile of the outer cam 12 and the inner cam 14, the cam profile can be made variable in a simulated manner. For this reason, basically, the profile of the outer cam 12 is used, whereas concerning the profile of the inner cam 14, only a portion thereof is used that is shifted in phase with respect to the outer cam 12.

Below, with reference to FIG. 1 and FIGS. 2A to 2C, a description will be given in detail concerning the structure of the camshaft 10 according to the present embodiment. The camshaft 10 is equipped with a cylindrical outer shaft 16, with the outer cams 12 being formed integrally on the outer circumference thereof. An inner shaft 18 is arranged rotatably inside the outer shaft 16, and the inner cams 14 are fixed to the inner shaft 18.

The outer cams 12 are constituted from three individual members, which are disposed at predetermined intervals along the axial direction (the direction of the arrow X in FIG. 1) of the outer shaft 16. Hereinafter, when descriptions are given separately of each of the three outer cams 12, they may also be referred to as a first outer cam 12*a*, a second outer cam 12*b*, and a third outer cam 12*c*. Stated otherwise, the first outer cam 12*a*, the second outer cam 12*b*, and the third outer cam 12*c* may also be referred to collectively as the outer cams 12. The first outer cam 12*a*, the second outer cam 12*b*, and the third outer cam 12*c* are arranged in this order from one end side (the X1 side in FIG. 1) to the other end side (the X2 side in FIG. 1) of the outer shaft 16.

Three notches 20, which are disposed respectively adjacent to locations where the three outer cams 12 are provided, are formed on the outer shaft 16. The respective notches 20 are arcuately shaped extending along the circumferential direction of the outer shaft 16, and as will be discussed later, the placement thereof in the circumferential direction is set so as to face the pin holes 22 that are formed in the inner shaft 18. Further, the width in the axial direction of the notches 20 is set to be greater than the large diameter portions 30 of the pins 28, as will be discussed later.

Among the locations on both sides adjacent to the notches 20 of the outer shaft 16, narrow diameter portions 34 are formed respectively on sides opposite to the outer cams 12. The narrow diameter portions 34 are locations at which opposite end sides in the diametrical direction of the outer circumferential wall of the outer shaft 16 are cut out in order to partially reduce the outer diameter of the outer shaft 16.

Further, journal portions 36 are provided, respectively, more on the other end side in the axial direction of the outer shaft 16 than the narrow diameter portions 34. The journal portions 36 are rotatably supported with respect to a cylinder head (not shown) of the internal combustion engine.

The inner shaft 18 is a solid round bar having a smaller diameter than the inner diameter of the outer shaft 16. Therefore, by disposing the inner shaft 18 coaxially in the interior of the outer shaft 16, a clearance is formed mutually between the inner circumferential surface of the outer shaft 16 and the outer circumferential surface of the inner shaft 18.

Further, bottomed pin holes 22, which extend along diametrical directions of the inner shaft 18, are provided in the same number as the number of cylinders at intervals along the axial direction of the inner shaft 18. More specifically, the pin holes 22 are made up from three members including a first pin hole 22*a*, a second pin hole 22*b*, and a third pin hole 22*c*. The first pin hole 22*a*, the second pin hole 22*b*, and the third pin hole 22*c* are arranged in this order from one end to the other end in the axial direction of the inner shaft 18.

Figure 2A:
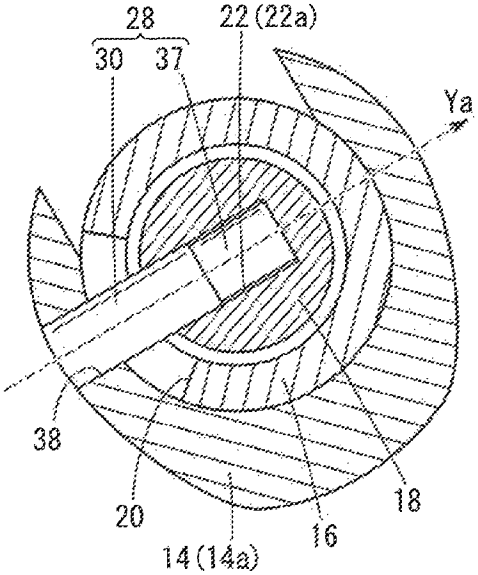
FIG. 2A is a schematic cross-sectional view of a region where a first inner cam of the camshaft of FIG. 1 is fixed.
Figure 2B:
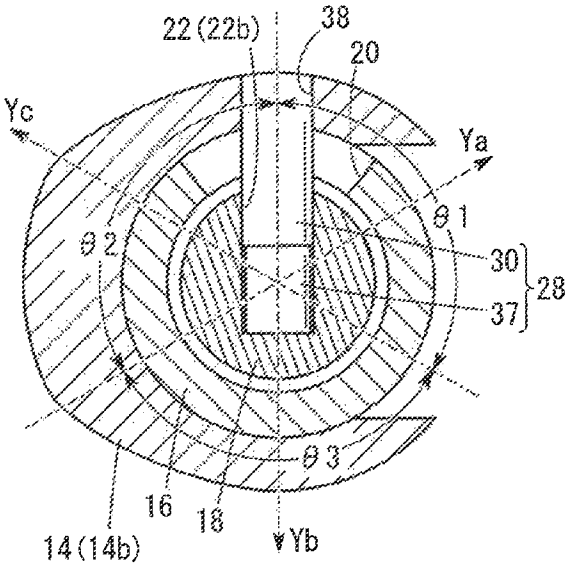
FIG. 2B is a schematic cross-sectional view of a region where a second inner cam is fixed.
Figure 2C:
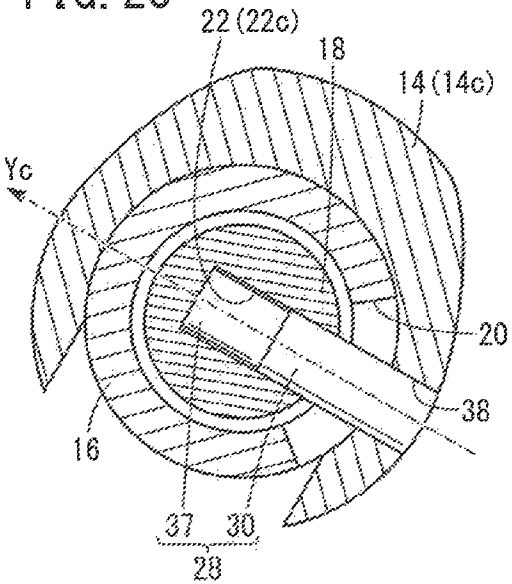
FIG. 2C is a schematic cross-sectional view of a region where a third inner cam is fixed.

The directions in which adjacent pin holes 22 extend are arranged at angles obtained by dividing 360 degrees by the number of cylinders (i.e., three). More specifically, the directions thereof are arranged at angles of 120 degrees. Therefore, as shown in FIGS. 2A and 2B, an angle θ1 of 120 degrees is formed between the direction of extension Ya of the first pin hole 22*a* and the direction of extension Yb of the second pin hole 22*b*. Similarly, as shown in FIGS. 2B and 2C, an angle θ2 of 120 degrees is formed between the direction of extension Yb of the second pin hole 22*b* and the direction of extension Yc of the third pin hole 22*c*. Further, at this time, as shown in FIG. 2B, an angle θ3 of 120 degrees is formed between the direction of extension Ya of the first pin hole 22*a* and the direction of extension Yc of the third pin hole 22*c*.

Each of the inner diameters of the pin holes 22 is of a size by which the small diameter portion 37 of the later-described pins 28 is loosely fitted (i.e., fitted with a clearance) therein, and the large diameter portion 30 is press-fitted therein. Stated otherwise, the diameters of the large diameter portions 30 of the pins 28 are greater than the diameters of the small diameter portions 37.

The inner cams 14 are substantially C-shaped in cross section, and in which an opening is provided between both ends in the circumferential direction thereof. The inner cams 14 are constituted from three individual members which are slidably mounted along the circumferential direction, respectively, at locations adjacent to the outer cams 12 of the outer shaft 16. More specifically, the inner cams 14 are made up from a first inner cam 14*a* adjacent to the first outer cam 12*a* and which is assembled mutually therewith, a second inner cam 14*b* adjacent to the second outer cam 12*b* and which is assembled mutually therewith, and a third inner cam 14*c* adjacent to the third outer cam 12*c* and which is assembled mutually therewith.

The distance between both end portions that form the respective openings of the inner cams 14 is slightly greater than the outer diameter of the narrow diameter portions 34 of the outer shaft 16, and less than the outer diameter of locations of the outer shaft 16 where the inner cams 14 are mounted. As will be discussed later, the openings of the inner cams 14 enable the narrow diameter portions 34 of the outer shaft 16 to be passed therethrough along a diametrical direction (the direction of the arrow Z1 shown in FIG. 3) of the inner cams 14.

Figure 3:
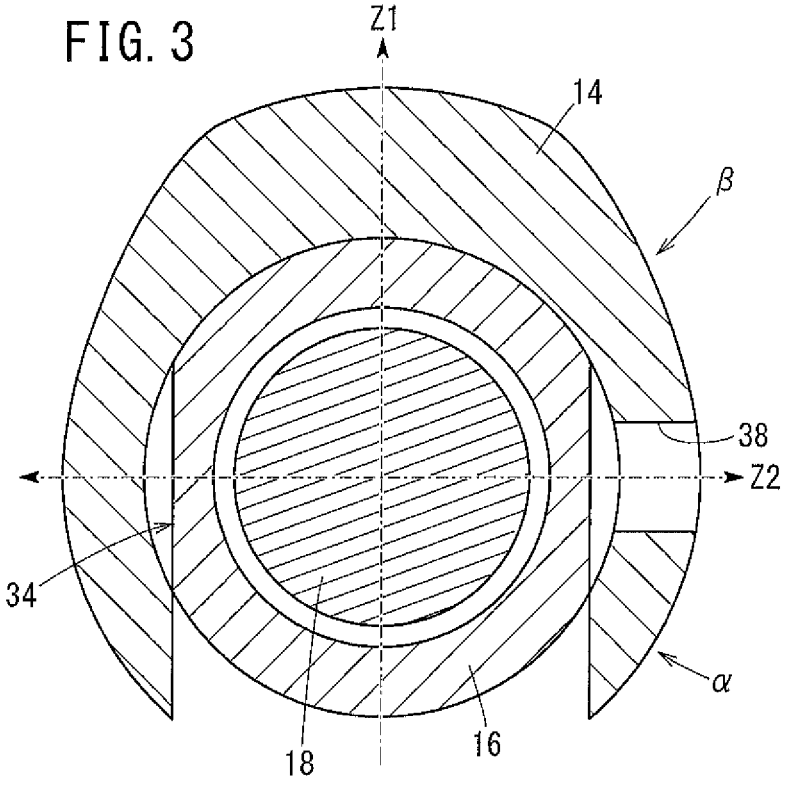
FIG. 3 is an explanatory diagram for describing a manufacturing method for the camshaft of FIG. 1.

As shown in FIG. 3, each of the inner cams 14 has defined as a boundary thereof a diametrical direction Z2, which is perpendicular to a direction Z1 in which the narrow diameter portion 34 is passed through the opening, such that when the circumferential direction is partitioned respectively into two half-circumferences on a side α of the opening and on a side β opposite to the opening, a single one of the insertion holes 38 is formed on a cam surface of the half-circumference on the side β opposite to the opening including the boundary. More specifically, the insertion holes 38 are formed to avoid both end sides of the inner cam 14 near to the opening. According to the present embodiment, the insertion holes 38 are formed on the aforementioned boundary. Inner diameters of the insertion holes 38 are set to a size that enables the large diameter portions 30 of the pins 28 to be loosely fitted therein.

As described above, in the camshaft 10, since the profiles of the inner cams 14 are used only for portions whose phases are shifted with respect to the outer cams 12, the insertion holes 38 can be formed in cam surfaces of the inner cams 14 at which the profiles thereof are not used. Further, by forming the inner cams 14 to be substantially C-shaped in cross section, with the locations thereof at which the profiles are not used being provided as openings, the weight of the inner cams 14 can be reduced in comparison with a cylindrically shaped inner cam. Further, costs can be reduced by reducing the amount of material required to form the inner cam 14.

As shown in FIGS. 1 and 2A through 2C, the inner cams 14 are mounted on the outer shaft 16 so that the insertion holes 38 thereof are disposed in facing relation to the notches 20 and the pin holes 22. More specifically, the insertion hole 38 of the first inner cam 14*a* faces the first pin hole 22*a* through the notch 20. The insertion hole 38 of the second inner cam 14*b* faces the second pin hole 22*b* through the notch 20. The insertion hole 38 of the third inner cam 14*c* faces the third pin hole 22*c* through the notch 20.

In addition, as shown in FIGS. 2A through 2C, the inner cams 14 are fixed to the inner shaft 18 in a state in which the large diameter portions 30 of the pins 28 are press-fitted into the pin holes 22 through the insertion holes 38 and the notches 20. Owing to this feature, the inner cams 14 can be rotated together with the inner shaft 18, and are capable of sliding along the circumferential directions of the outer circumferential surface of the outer shaft 16. At this time, because the length of the inner cams 14 in the circumferential direction is set so as to cover one half (180 degrees) or more in the circumferential direction of the outer shaft 16, detachment or separation of the inner cams 14 from the outer shaft 16 can be prevented.

The camshaft 10 according to the present embodiment is basically constructed in the manner described above. Next, with further reference to FIG. 3 and FIGS. 4A, 4B, and 4C, a method of manufacturing the camshaft 10 will be described.

At first, the inner shaft 18 is arranged in the interior of the outer shaft 16 after the outer cams 12 have been formed integrally therewith, and the notches 20, the narrow diameter portions 34, and the journal portions 36 have been formed thereon, respectively. At this time, the notches 20 and the pin holes 22 are placed in facing relation, and the outer shaft 16 and the inner shaft 18 are positioned coaxially. In addition, both ends of the outer shaft 16 and the inner shaft 18 are supported so that such a condition is maintained.

Next, the inner cams 14 are attached and mounted with respect to the outer shaft 16. More specifically, as shown in FIG. 3, the narrow diameter portions 34 of the outer shaft 16 are inserted through the openings of the inner cams 14 into the base circular portions thereof. In addition, the inner cams 14 are made to slide toward the one end side in the axial direction of the outer shaft 16, and are arranged adjacent to the outer cams 12. At this time, the insertion holes 38 of the inner cams 14 and the notches 20 of the outer shaft 16 are placed in facing relation to each other.

More specifically, by forming the inner cams 14 to be substantially C-shaped in cross section as described above, the inner cams 14 can be mounted easily on the outer shaft 16 after the outer cams 12 have been provided thereon. Moreover, any one of the first inner cam 14*a*, the second inner cam 14*b*, and the third inner cam 14*c* may be attached with respect to the outer shaft 16, and the inner cams may be attached in any order.

Figure 4A:
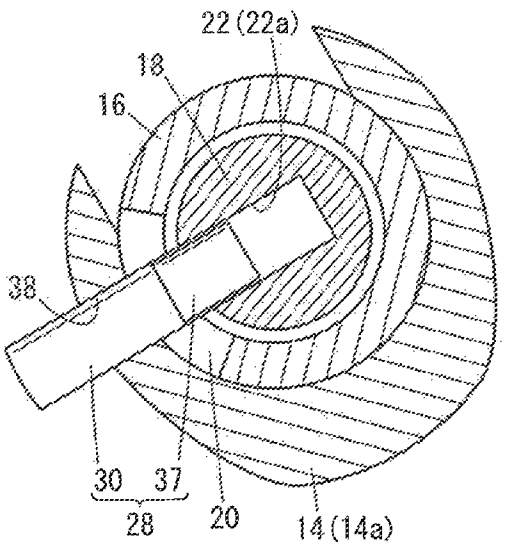
FIGS. 4A through 4C are other explanatory diagrams for describing the manufacturing method for the camshaft of FIG. 1.
Figure 4B:
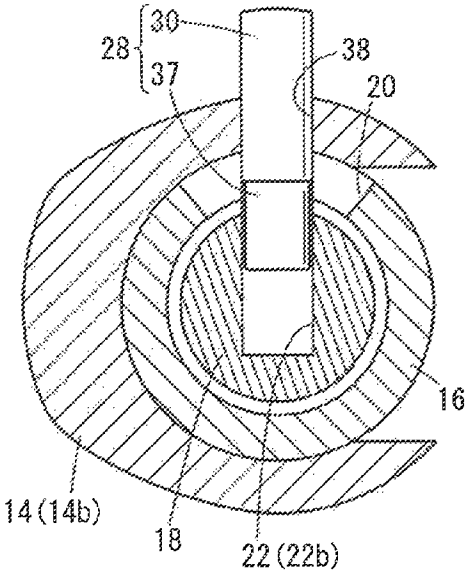
Figure 4C:
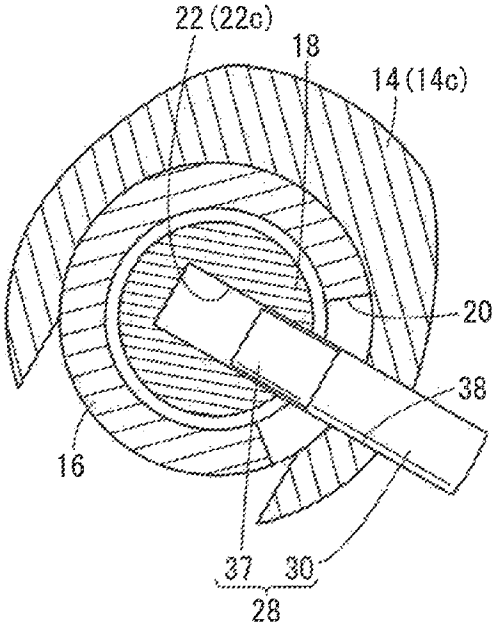

Next, as shown in FIGS. 4A through 4C, the small diameter portions 37 of the pins 28 are loosely fitted with respect to all of the first through third pin holes 22*a* to 22*c* through the insertion holes 38 and the notches 20. At this time, although loose fitting of the small diameter portions 37 may be carried out in any order with respect to the first through third pin holes 22*a* to 22*c*, preferably, the small diameter portions 37 are loosely fitted simultaneously with respect to all of the first through third pin holes 22*a* to 22*c*. In this case, because such loose fitting is carried out uniformly from directions that differ respectively in the circumferential direction of the inner shaft 18, the occurrence of displacement in the inner shaft 18 can be avoided more effectively.

Next, the large diameter portions 30 of the pins 28 are press-fitted, respectively, into the pin holes 22. At this time, as discussed above, by loosely fitting the small diameter portions 37 with respect to all of the pin holes, i.e., the first pin hole 22*a* through the third pin hole 22*c*, the inner shaft 18 can be supported uniformly from directions that differ respectively in the circumferential direction. Owing to this feature, since the large diameter portions 30 can be press-fitted into the pin holes 22 in a state in which displacement of the inner shaft 18 is suppressed, the inner cams 14 can be fixed to the inner shaft 18 while suppressing the occurrence of bending or flexure of the inner shaft 18.

At this time, displacement of the inner shaft 18 can be suppressed in the manner described above, even if the large diameter portions 30 are press-fitted in any order with respect to the first through third pin holes 22*a* to 22*c*. However, in particular, it is preferable for the large diameter portions 30 to be press-fitted simultaneously with respect to all of the first through third pin holes 22*a* to 22*c*. In this case, frictional resistance due to press-fitting of the large diameter portions 30 is generated uniformly from different directions, respectively, in the circumferential direction of the inner shaft 18. Consequently, bending of the inner shaft 18 by displacement of the inner shaft 18 in one particular direction can be avoided more effectively.

Further, in the case that the large diameter portions 30 are press-fitted simultaneously with respect to all of the first through third pin holes 22*a* to 22*c*, while confirming the relative positioning of the inner shaft 18 with respect to the outer shaft 16, fine adjustments can be made to the respective speeds at which the plurality of pins 28 are press-fitted into the first through third pin holes 22*a* to 22*c*. In accordance with this feature, it is possible to suppress displacement of the inner shaft 18 with higher accuracy.

Furthermore, the large diameter portions 30 may be press-fitted, at first, from the first pin hole 22*a* and the third pin hole 22*c* disposed on respective sides nearer to both ends in the axial direction of the inner shaft 18 than the second pin hole 22*b* disposed at a center side in the axial direction of the inner shaft 18. More specifically, the large diameter portions 30 may be press-fitted, for example, in order of the first pin hole 22*a*, the third pin hole 22*c*, and the second pin hole 22*b*.

As discussed above, although both ends of the inner shaft 18 can be supported in a state of being positioned with respect to the outer shaft 16, it is difficult to support the central portion of the inner shaft 18, which is disposed in the interior of the outer shaft 16. Therefore, when the large diameter portions 30 of the pins 28 are press-fitted into the pin holes 22, the center side in the axial direction of the inner shaft 18 is more likely to undergo flexure than both end sides thereof.

Thus, initially, the large diameter portions 30 are press-fitted into the first pin hole 22*a* and the third pin hole 22*c* on both end sides of the inner shaft 18 where it is relatively difficult for flexure to take place. Consequently, at first, both end sides of the inner shaft 18 are positioned and fixed in a state in which flexure is suppressed. Therefore, the large diameter portion 30 of the remaining pin can be press-fitted into the second pin hole 22*b*, in a state in which it is difficult for bending or flexure to occur at the location of the inner shaft 18 which is more on the center side than the first pin hole 22*a* and the third pin hole 22*c* where the large diameter portions 30 have been press-fitted. In this manner, by press-fitting the large diameter portions 30 sequentially into the pin holes 22, it is possible to more effectively suppress bending or flexure from occurring over the entire axial direction of the inner shaft 18.

Furthermore, the insertion holes 38 are formed at the aforementioned positions in which both end sides of the inner cam 14 near to the opening are avoided, and the pin holes 22 are formed as bottomed holes. Therefore, even if the large diameter portions 30 of the pins 28 are inserted into the pin holes 22 through the insertion holes 38, it is possible to avoid application of stresses, which may result in damage, with respect to locations on both sides near the openings of the inner cams 14.

In the foregoing manner, the inner cams 14 are fixed to the inner shaft 18, by press-fitting of the large diameter portions 30 of the pins 28 into all the first through third pin holes 22*a* to 22*c* through the insertion holes 38 and the notches 20. As a result, a camshaft 10 can be obtained in which, by causing the inner shaft 18 to rotate relatively with respect to the outer shaft 16, the inner cams 14 rotate in following relation (i.e., in co-rotation) with the inner shaft 18, and slide in the circumferential direction along the outer circumferential surface of the outer shaft 16. More specifically, relative positioning between the outer cams 12 and the inner cams 14 can be made variable, and consequently, it is possible to arbitrarily control the opening angles and opening times of the engine valves (not shown).

With the camshaft 10, as described above, flexure of the inner shaft 18 can be suppressed effectively at the interior of the outer shaft 16. Therefore, without the outer circumferential surface of the inner shaft 18 coming into contact with the inner circumferential surface of the outer shaft 16, the inner shaft 18 and the outer shaft 16 are positioned in a state with a clearance formed mutually therebetween. Accordingly, since there is no occurrence of frictional resistance mutually between the outer shaft 16 and the inner shaft 18, even though the outer shaft 16 and the inner shaft 18 undergo relative rotation, there is no obstruction to the relative rotation therebetween. Consequently, the relative positioning between the outer cams 12 and the inner cams 14 can be adjusted with high accuracy. Further, since frictional wear due to contact between the outer shaft 16 and the inner shaft 18 can be suppressed, the durability of the camshaft 10 can be enhanced.

Even if the occurrence of flexure in the inner shaft 18 is suppressed in the foregoing manner, there is no need for additional processing steps, such as a caulking step for fixing the pins 28 in the pin holes 22, or a step after the pins 28 have been press-fitted into the pin holes 22 of moving the pins 28 in directions opposite to the direction in which they were press-fitted. Therefore, the camshaft 10 can be obtained easily and efficiently.

Further, the pin holes 22 are arranged at angles of 120 degrees that differ mutually with respect to the circumferential direction of the inner shaft 18, and therefore, the notches 20, which are formed in facing relation to the pin holes 22, also are arranged at angles of 120 degrees which differ with respect to the circumferential direction of the outer shaft 16. With such an inner shaft 18 and an outer shaft 16, since the plural pin holes 22 or the notches 20 are arranged evenly along the circumferential direction, it is possible to suppress the occurrence of anisotropy in the rigidity thereof.

As described above, in the camshaft 10, the outer cams 12 and the inner cams 14 can be relatively displaced with high accuracy, and the camshaft 10 is superior in terms of durability and manufacturing efficiency.

The present invention is not limited in particular to the above-described embodiment, and various modifications can be made thereto without deviating from the essence and gist of the present invention.

At first, with the camshaft 10 according to the above-described embodiment, one insertion hole 38 is formed at the aforementioned boundary of the inner cams 14, and the pin holes 22 are bottomed holes. However, the invention is not particularly limited to this feature. For example, as with the camshaft 40 shown in FIG. 5, a pair of two insertion holes 42 that face one another may be formed in the inner cam 14 along a diametrical direction thereof. Further, as with the camshaft 40, pin holes 46 may be formed to penetrate through the inner shaft 18. In such cases, two notches 20 are formed to face one another along the diametrical direction with respect to the outer shaft 16.

Figure 5:
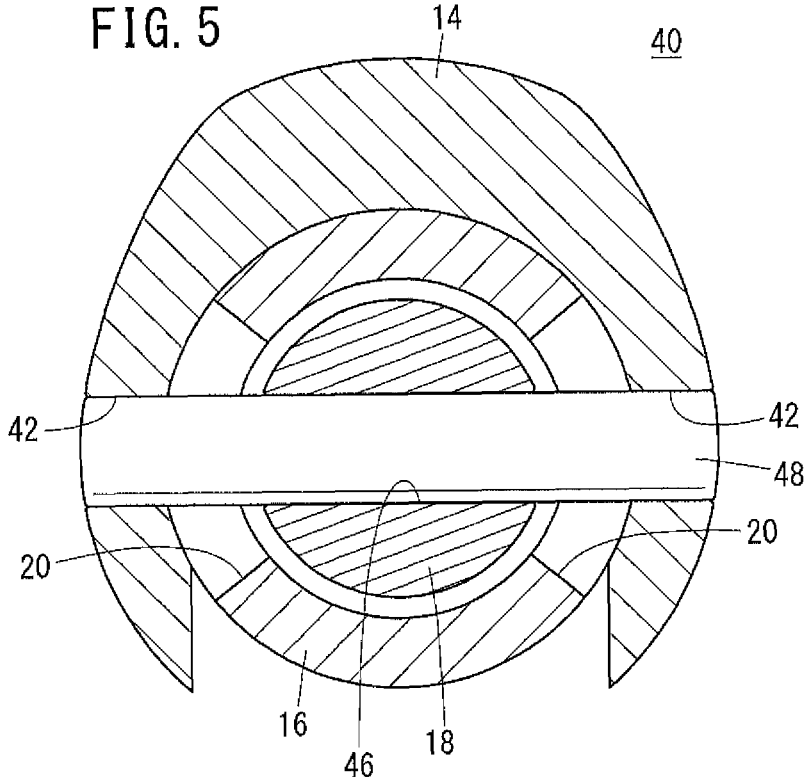
FIG. 5 is a schematic cross-sectional view of a region where an inner cam of the camshaft is fixed according to another embodiment of the present invention.

Among the structural elements shown in FIG. 5, those which exhibit the same or similar functions and effects as the structural elements shown in FIGS. 1 to 4C are denoted by the same reference characters, and detailed description of such features is omitted.

Even with the camshaft 40 provided with the configuration described above, in the same manner as the camshaft 10, since bending or flexure of the inner shaft 18 can be suppressed, the outer cams 12 and the inner cams 14 can be relatively displaced with high accuracy, and the camshaft 40 is superior in terms of durability and manufacturing efficiency.

Further, in the case of being press-fitted simultaneously with respect to all of the pin holes 22 or all of the pin holes 46, as with the pins 48 shown in FIG. 5, the diameters thereof may be uniform. The diameters of the pins 48 may be of a size such that they are capable of being loosely fitted into the insertion holes 38, 42 and are press-fitted into the pin holes 22, 46.

Furthermore, because the camshaft 10 is used in a three-cylinder internal combustion engine, it includes three pairs of the outer cam 12 and the inner cam 14, and three pin holes 22 are formed in the inner shaft 18. However, the camshaft according to the present invention can be applied not only to a three-cylinder internal combustion engine. In this case, it is acceptable if the inner shaft 18 is formed with the same number of pairs of outer cams 12 and inner cams 14 as the number of cylinders, and the same number of pin holes 22 as the number of cylinders of the internal combustion engine. Further, since the directions in which adjacent pin holes 22 extend are arranged at angles obtained by dividing 360 degrees by the number of cylinders, for example, in the case of being used in a four-cylinder internal combustion engine, the angle formed by the directions in which the adjacent pin holes 22 extend may be 90 degrees.

Further still, the number of pin holes 22 formed in the inner shaft 18 does not have to be the same as the number of cylinders of the internal combustion engine. For example, plural sets of two or more pin holes 22 may be arranged at angles obtained by dividing 360 degrees by the number of cylinders. The pin holes 22 of each set extend in the same direction.

Further still, although the camshaft 10 according to the above embodiments is equipped with the inner cams 14 having a substantially C-shaped cross section with openings provided therein, the present invention is not limited to this feature, and the camshaft 10 may also be equipped with annular shaped inner cams (not shown).

What is claimed is:

1. A camshaft for opening and closing engine valves provided respectively in a plurality of cylinders of an internal combustion engine, comprising:

a cylindrical outer shaft on which outer cams are provided on an outer circumference thereof;

an inner shaft disposed rotatably in the interior of the outer shaft; and inner cams, which are fixed to the inner shaft by pins, through notches of the outer shaft, whereby the inner cams are rotated together with the inner shaft, and slide along a circumferential direction on an outer circumferential surface of the outer shaft;

wherein:

the pins each comprise a small diameter portion and a large diameter portion which is larger in diameter than the small diameter portion;

the inner shaft is provided with a plurality of pin holes therein which extend along diametrical directions of the inner shaft, the pin holes are disposed at intervals along an axial direction of the inner shaft, and the directions in which adjacent pin holes extend are arranged at an angle obtained by dividing 360 degrees by the number of cylinders;

each of the pin holes has an inner diameter so that the small diameter portion is loosely fitted, and the large diameter portion is press-fitted therein;

the inner cams are formed with insertion holes having an inner diameter into which the large diameter portion is loosely fitted; and the inner shaft and the inner cams are fixed in a state in which the large diameter portions are press-fitted into the pin holes through the insertion holes and the notches.

2. The camshaft according to claim 1, wherein:

the inner cams are C-shaped in cross section, in which an opening is provided between both ends in the circumferential direction thereof that enables the outer shaft to be passed therethrough along a diametrical direction, and are mounted to locations adjacent to the outer cams of the outer shaft slidably along a circumferential direction thereof; and a distance between both end portions that form the opening of the inner cams is less than an outer diameter of locations of the outer shaft where the inner cams are mounted.

3. The camshaft according to claim 2, wherein:

each of the inner cams has defined as a boundary thereof a diametrical direction, which is perpendicular to a direction in which the outer shaft is passed through the opening, and when the circumferential direction is partitioned respectively into two half-circumferences on a side of the opening and on a side opposite to the opening, a single one of the insertion holes is formed on a cam surface of the half-circumference on the side opposite to the opening including the boundary; and the pins, which are inserted into the pin holes through the insertion holes and the notches, do not pass through the inner shaft.

4. A method for manufacturing a camshaft for opening and closing engine valves provided respectively in a plurality of cylinders of an internal combustion engine, comprising:

a fixing step of fixing inner cams with respect to an inner shaft, which is disposed rotatably in interior of an outer shaft on which outer cams are provided on an outer circumference thereof, the inner cams being fixed by pins through notches that are formed in the outer shaft;

wherein the inner shaft is provided with a plurality of pin holes therein which extend along diametrical directions of the inner shaft, the pin holes are disposed at intervals along an axial direction of the inner shaft, and the directions in which adjacent pin holes extend are arranged at an angle obtained by dividing 360 degrees by the number of cylinders;

the inner cams are formed with insertion holes having an inner diameter into which the pins are loosely fitted; and in the fixing step, the inner cams are fixed to the inner shaft by press-fitting the pins respectively through the insertion holes and the notches simultaneously with respect to all of a plurality of the pin holes.

5. A method for manufacturing a camshaft for opening and closing engine valves provided respectively in a plurality of cylinders of an internal combustion engine, comprising:

fixing step of fixing inner cams with respect to an inner shaft, which is disposed rotatably in interior of an outer shaft on which outer cams are provided on an outer circumference thereof, the inner cams being fixed by pins through notches that are formed in the outer shaft;

wherein the pins each comprise a small diameter portion and a large diameter portion which is larger in diameter than the small diameter portion;

the inner shaft is provided with a plurality of pin holes therein which extend along diametrical directions of the inner shaft, the pin holes are disposed at intervals along an axial direction of the inner shaft, and the directions in which adjacent pin holes extend are arranged at an angle obtained by dividing 360 degrees by the number of cylinders;

each of the pin holes has an inner diameter so that the small diameter portion is loosely fitted, and the large diameter portion is press-fitted therein;

the inner cams are formed with insertion holes having an inner diameter into which the large diameter portion is loosely fitted, the insertion holes being coaxial with the pin holes; and in the fixing step, the inner cams are fixed to the inner shaft, at first, by loosely fitting the small diameter portions respectively through the insertion holes and the notches simultaneously with respect to all of a plurality of the pin holes, and thereafter, by press-fitting the large diameter portions respectively into the pin holes.

6. The method for manufacturing the camshaft according to claim 5, wherein, in the fixing step, the large diameter portions are press-fitted, respectively, simultaneously with respect to all of the plurality of pin holes.

7. The method for manufacturing the camshaft according to claim 5, wherein, in the fixing step, the large diameter portions are press-fitted, at first, from pin holes disposed on respective sides nearer to both ends in the axial direction of the inner shaft than a pin hole disposed at a center side in the axial direction of the inner shaft.

* * * * *